United States Patent [19]

Ohtomo et al.

[11] 3,996,327

[45] Dec. 7, 1976

[54] PROCESS FOR SPINNING COMPOSITE FIBER OF PHENOLIC RESIN

[75] Inventors: Koichiro Ohtomo, Takatsuki; Thuyoshi Nakamori, Osaka, both of Japan

[73] Assignee: Nippon Kynol Inc., Osaka, Japan

[22] Filed: Oct. 14, 1975

[21] Appl. No.: 621,846

Related U.S. Application Data

[63] Continuation of Ser. No. 424,696, Dec. 14, 1973, abandoned.

[30] Foreign Application Priority Data

Dec. 20, 1972 Japan ..... 47-127905
Oct. 15, 1973 Japan ..... 48-115511

[52] U.S. Cl. ..... 264/168; 264/171; 264/236; 428/369; 428/374

[51] Int. Cl.[2] ..... B29F 3/10

[58] Field of Search ..... 428/369, 374; 264/168, 264/171, 236

[56] References Cited

UNITED STATES PATENTS

| | | | |
|---|---|---|---|
| 3,639,953 | 2/1972 | Kimura et al. | 264/29 |
| 3,651,199 | 3/1972 | Blume et al. | 264/347 |
| 3,808,289 | 4/1974 | Okuhashi et al. | 260/841 |
| 3,928,526 | 12/1975 | Koyama | 264/347 |
| 3,931,386 | 1/1976 | Kimura et al. | 264/347 |

*Primary Examiner*—Jay H. Woo
*Attorney, Agent, or Firm*—Sherman & Shalloway

[57] ABSTRACT

A method of producing a self-crimping composite fiber of phenolic resin having heat-resistant and flameproof properties which comprises compositely spinning a thermoplastic phenolic resin and a modified phenolic resin consisting of a thermoplastic resin and another thermoplastic resin, such that the two components are united in either an eccentric or side-by-side arrangement, and thereafter curing the resulting thermoplastic composite fiber.

18 Claims, No Drawings

PROCESS FOR SPINNING COMPOSITE FIBER OF PHENOLIC RESIN

This is a continuation of application Ser. No. 424,696, filed Dec. 14, 1973, now abandoned.

This invention relates to a method of producing a self-crimping phenolic composite fiber excelling in heat resistance and is flameproof.

The fiber obtained by fiberizing, by means of the melt-spinning process, either a phenolic resin or a heat-meltable material consisting predominantly of such resin and thereafter carrying out the crosslinking reaction by utilizing subjecting its phenol ring to the three-dimensionalized cure of the fiber has been known in the past as being a flameproof fiber.

For instance, the cured phenolic resin fiber obtained by melt-spinning the novolak resin obtained by the condensation of phenol and formaldehyde and thereafter carrying out the crosslinking of the resulting fiber with a combined solution of hydrochloric acid and formalin has the properties of being heat infusible and solvent insoluble, as well as being flameproof. Thus, this fiber can be recommended as being a fibrous material suitable for use in places where fire hazards exist, e.g., for use in the interior decoration field or as flameproof clothings.

However, since this phenolic fiber has been cross-linked to a high degree, it is usually brittle. Hence, in spinning the staples of this fiber, great difficulty is experienced not only when it is spun alone but also when it is mixed spun with other fibers. In addition, not only does the resulting yarn have a small elongation, but also the properties of the final product are not satisfactory. On the other hand, when this fiber is used as a filament yarn, the resulting knit or woven fabric usually has a cold feel and, again, the fabric does not have elasticity. For this reason, there are studies underway to find a method of imparting mechanical crimps to this phenolic fiber but because of the foregoing brittleness, considerable difficulty is involved.

The melt-spinning of the phenolic resins is difficult, as a rule. For solving this problem, the method of spinning the phenolic resins after mixing them with other heat-meltable resins is known. However, for achieving good spinnability in this case, a considerably large amount of the other heat-meltable resin must be admixed. As a consequence, there is the drawback that a great drop is brought about in the flame resistance, the characteristic feature of the phenolic resins.

As a consequence of our extensive research with a view to solving the various foregoing deficiencies of the conventional techniques, we arrived at the present invention.

An object of the present invention is to provide a self-crimping phenolic fiber which not only has good spinnability but also excels in elongation and recovery. Another object is to improve the spinnability of the phenolic resins without impairing the heat-resistant and flameproof properties of these resins.

Accordingly, the present invention is directed to a method of producing a self-crimping phenolic composite fiber having heat-resistant and flameproof properties, which comprises melt-spinning (a) a modified phenolic resin obtained by melt blending a heat-meltable phenolic resin with 0.5 –30 % by weight, based on the total weight of the mixture, of a heat-meltable fiber-forming resin other than phenolic resins, and (b) a heat-meltable phenolic resin such that the components (a) and (b) are united in an eccentric or side-by-side relationship, and thereafter submitting the resulting heat-meltable composite fiber to a treatment which cures the phenolic resin component contained therein.

Hitherto, a method of developing crimps by treatment of a composite filament composed of two components of differing shrinkability united in either an eccentric or side-by-side relationship, i.e., one in which the components are arranged and united continuously in the lengthwise direction of the filaments in an eccentric or side-by-side relationship over the cross section of the filament with hot water, for example, is being practiced, but in this method the stability of the crimps is low. On the other hand, the invention method comprises subjecting the heat-meltable fiber obtained by the composite spinning to a curing treatment to three-dimensionalize the phenolic resin component contained in the fiber thereby to impart crimpability to the fiber. Hence, the invention method is an entirely new method. It is possible according to the present invention to control the degree of development of crimpability and the time of appearance of the crimps in accordance with the aforesaid curing conditions and the degree of the cure.

The phenolic resins preferably used in the method of this invention are those usually of a molecular weight ranging from 500 to 3000 obtained by the condensation reaction by heating phenol or at least one of such phenols as cresol, p-tert.butyl phenol or chlorophenol, and the so-called aldehydes such as formaldehyde, paraformaldehyde, hexamethylenetetramine and furfural, in the presence of an inorganic or organic acid catalyst such as hydrochloric acid, sulfuric acid, phosphoric acid, p-toluenesulfonic acid and phenolsulfonic acid. Hence, these resins usually consist predominantly of novolak, but there is imposed no restriction at all as to their molecular weight, degree of polymerization or structure as long as they are heat meltable. Resol may also be contained in part in the phenolic resin.

As the various other heat-meltable resins other than the phenolic resins that can be used in the invention method, included are the fiber-forming polymers such, for example, as the polyamides, polyesters, polyurethanes and polyolefins. As the polyamide polymers, mention can be made of such, for example, as nylon 6, nylon 7, nylon 11 and nylon 12, as well as the polyamides obtained by the polymerization of a dicarboxylic acid having an aliphatic, aromatic or alicyclic nucleus, such as adipic acid, sebacic acid, terephthalic acid and isophthalic acid or the hydrogenation products thereof, with a diamine such as ethylenediamine, hexamethylenediamine, nonamethylenediamine, undecamethylenediamine, xylylenediamine or piperazine. The polyesters include polyethylene terephthalate as well as polyoxybenzoate, or the copolymers having these as one of their components. As the polyolefins, mention can be made of polyethylene, polypropylene and polystyrene. Or, when nonflammability is especially desired in the composite fiber product, coal tar or asphalt pitches and resol containing upwards of 15 % of methylol can also be used.

When considered from the compatibility with the phenolic resins, the polyamide are especially preferred among the foregoing resins, and particularly to be preferred is a polyamide which not only has a melting point not exceeding 250° C. but is acid resistant as well. The reason is that in the case of polyamide having a melting point exceeding 250° C., elevated temperatures are required for its mixing with the phenolic resins, with the consequence that the spinnability of the phenolic resins tends to become poor. On the other hand, in the case of a polyamide having poor resistance to acids, hydrolysis of the polyamide is set up at the time of the hereinafter-described curing treatment that is carried out in accordance with the present invention, with the consequence that the yarn quality of the finally obtained cured phenolic composite fiber is unsatisfactory. Hence, usually used is a polyamide which, when tested by introducing a fibrous polyamide into a 5 weight % aqueous hydrochloric acid solution and treated for 1 hour at 50° C., has a weight loss of less than 25 %, preferably less than 10 %, and most preferably less than 5 %. Further, the foregoing heat-meltable resins can also be used as mixtures of two or more classes thereof.

In preparing the modified phenolic resin component (a) by melt blending the foregoing heat-meltable resins with the phenolic resins, the two components may be mixed in advance in a melt-blending extruder or the two components may be directly fed in, say, chip form to the extruding spinning machine at the time of spinning of the composite fibers.

The heat-meltable resin is added to the phenolic resin in an amount, based on the total amount of the mixture, of 0.5 –30 % by weight, preferably 1 –10 % by weight, and most preferably 2 –7 $% by weight. When the heat-meltable resin is added in an amount of less than 0.5 % by weight, adequate crimping cannot be obtained, whereas when this amount exceeds 30 % by weight, the crimping and spinning properties are satisfactory but, on the other hand, the nonflammability of the resulting products is inadequate, and hence this is undesirable from the standpoint of imparting heat resistance and flameproofness to the product.

The so obtained modified phenolic resin (a) containing a suitable amount of a heat-meltable resin is then spun along with a phenolic resin (b) simultaneously from the same hole of a known composite spinneret, following which the spun filament is wound up in customary manner while being cooled. As regards the form in which the components are united, either the side-by-side or the eccentric core-sheath form will do. Again, the weight ratio of (a) to (b) may be chosen optionally. For instance, this ratio may be 10/90 –90/10 , and preferably 20/80 –80/20 , especially preferred being a ratio ranging from 40/60 –60/40.

However, when it is intended in this case to improve the spinnability of the fiber as much as possible by using the heat-meltable resins other than the phenolic resin in an amount in excess of 10 parts by weight and further to use the resulting composite fiber in the form of a filament yarn, preferred instead of the side-by-side form is the eccentric core-sheath form which consists of a core of the modified phenolic resin (a) and a sheath of the phenolic resin (b). In this case a much more improved nonflammability can be achieved. Again in the case of the side-by-side arrangement, measures must be taken to ensure that the nonflammability is not impaired by suitably varying the ratio of the components (a) and (b) that are united.

The heat-meltable composite fiber obtained by the melt-spinning operation is then submitted to a curing treatment thereby three-dimensionalizing the phenolic resin contained in the fiber to thus develop the crimps. Preferred modes of carrying out the curing treatment will described below.

The heat-meltable composite fiber is immersed and held, for example, for 0 –2 hours at room temperature in a combined aqueous solution containing 0.1 –25 % by weight of a catalyst selected from the inorganic acids such as hydrochloric acid and sulfuric acid, or an organic acid such as formic acid, benzenesulfonic acid, toluenesulfonic acid and phenolsulfonic acid and 0.5 –35 % by weight of such aldehydes as are typified by formaldehyde, after which the temperature of the solution is raised up to 50°–105° C. thereby curing the phenolic resin contained in the sheath layer of the fiber. The state of the crimps (number of crimps and size) can be freely adjusted by varying the rate of temperature rise, the maximum temperature used and the concentration of the curing bath. Generally speaking, the degree of crimping obtained increases as the rate of temperature rise, maximum temperature used and concentration of the curing bath become higher. Next, after raising the temperature, the heat treatment is continued for a further 0.1 –40 hours at 50°–105° C. thereby effecting a still greater stabilization of the crimps, as well as to cause the fiber to become insoluble and infusible and to render it nonflammable. While it is preferred to usually use the curing agents such as indicated hereinbefore in the curing treatment, it is also possible to incorporate in advance in the heat-meltable resin a reagent which forms an aldehyde on thermal decomposition, such, for example, as tetraoxane, and cure the phenolic resin by the thermal decomposition of this reagent.

On the other hand, as another procedure it is possible to carry the cure to the interior of the fiber by the following procedure. In the first stage of the curing treatment described above the time at which the temperature is held at 50°–105° C. after raising the temperature is held to within 0 –2 hours to effect partial cure of the sheath layer. Then as the second stage of the curing treatment the fiber is immersed at room temperature in a combined aqueous solution containing 0.2 –15 % by weight of a basic catalyst such as ammonia or an amine and 1 –40 % by weight of an aldehyde, followed by raising the temperature to 70°–90° C., at which temperature the reaction is continued for a further 0.5 –10 hours. By this two-stage curing treatment a composite fiber in which the degree of crimp and stability of the crimps are enhanced somewhat can be obtained.

In carrying out the foregoing second stage curing treatment, it is possible to incorporate either the urea bond or the thiourea bond in the crosslinked phenolic resin molecules by using as the curing treatment liquid a combined solution of either an acid catalyst or a basic catalyst and an aldehyde in which has been incorporated a small amount of either urea, thiourea or a methylol derivative thereof, whereby it becomes possible to provide a composite fiber which is thermally infusible, solvent insoluble and nonflammable, and excelling especially in heat resistance.

Thus, in accordance with the present invention, as a consequence of having submitted the composite heat-meltable resin fiber to a curing treatment, a self-crimping nonflammable phenolic composite fiber can be obtained. For forming in this case a composite fiber having firmly set crimps and excelling in elongation and recovery, the crosslinking of the phenolic resin component by means of the curing treatment must not be excessive. The degree of crosslinking suitable in the case of the invention method is 5 –45 mol %, and preferably 10 –35 mol %. By the expression "degree of crosslinking," as here used, is meant the degree of tri-substitution of the phenol nucleus contained in the resulting composite fiber, and this can be readily calculated by using the infrared spectrum. When the degree of crosslinking is less than 5 mol %, the crimps obtained are weak and the elongation recovery is poor. On the other hand, when 45 mol % is exceeded, the degree of crosslinking being too high, this also is undesirable, since the yarn quality suffers. A degree of crosslinking coming within the foregoing range can be realized by employment of the hereinbefore-indicated curing conditions.

Now, in practicing the hereinbefore-described curing treatment on a large commercial scale, it frequently happens that agglutination between the individual filaments takes place in the curing bath. This must be especially guarded against. Especially in the case where the curing treatment is carried out by the batch method wherein the packing density of the filaments is high, as a consequence of the shrinkage of the filaments that takes place in concomitance with the formation of crimps, the filaments become adhered to each other to cause at the same time a nonuniform curing of the filaments. Hence, this results in hindering the smooth operation of the cure, and this makes it difficult to obtain products of good quality. For avoiding this difficulty, either the packing density of the filaments must be reduced or the continuous method wherein the filaments are fed in small amounts continuously must be employed. However, as a result of extensive research, a much more improved method has been found. This new method consists fundamentally of avoiding the agglutination of the filaments from taking place by inhibiting as much as possible the development of the crimps in the curing bath and thereafter treating the resulting cured composite filaments with a swelling agent, thereby developing the desired crimps. In other words, the crimps are kept as much as possible in their latent state in the filaments during the curing process and are then developed and made manifest in the following swelling process. This method provides good quality products having much more uniform crimps.

The inhibition of crimp development in the curing bath can be achieved by an adjustment of the curing conditions to be employed, as by the use of a curing bath of suitable composition and employment of a relatively mild rate of temperature rise and maximum temperature. These curing conditions and a preferred mode of carrying out the swelling treatment will be more fully described below. In the following description the acidic and basic substances used as catalyst in the curing bath, as well as the aldehydes used therein as the curing agent are the same as those hereinbefore mentioned, and the percentages thereof are on a weight basis.

The first stage curing treatment is carried out by immersing the heat-meltable composite fiber at room temperature in a curing bath of a combined aqueous solution containing 10 –20 % of an acidic catalyst and 3 –18 % of an aldehyde with a provision that the acidic catalyst is contained in a greater amount than the aldehyde, raising the temperature of the bath gradually up to 50°–90° C. during a period of 0.5 –10 hours, and then holding the bath at this temperature for 0 –2 hours. The second stage of the curing treatment is carried out by immersing the fiber obtained from the first stage curing treatment in a curing bath of a combined aqueous solution containing 0.3 –7 % of an acidic or basic catalyst and 20 –40 % of an aldehyde, i.e., that in which the content of aldehyde is greater, when the fiber is treated for 0.5 –5 hours at a temperature of 70°–100° C. From the standpoint of the stability of pH and ease of operation, an acidic catalyst rather than a basic catalyst is preferred as the catalyst for this second curing bath. However, in the case where a greater number of crimps is desired as a result of the subsequent swelling treatment, preferred is a basic catalyst.

Since the content of catalyst is great in the aforesaid first stage curing bath and the degree to which the filament is swelled is low, the cure of the sheath layer proceeds while the crimps are inhibited. On the other hand, since the content of catalyst in the second stage curing treatment is small, a curing bath having a somewhat higher swellability is used, and the cure proceeds to the inner layer of the filament. Thus, a cured composite fiber having a degree of crosslinking of 5 –45 mol %, and preferably 10 –35 mol %, as hereinbefore specified, but in which the crimps are inhibited and present in a latent state is obtained.

Next, when this cured composite fiber is treated with a swelling agent, the desired uniform crimps are developed. The swelling treatment is suitably carried out by a procedure consisting of immersing the fiber in a swelling bath of a liquid ratio (fiber weight : swelling liquid weight) of 1 : 30 –1 : 300 and holding it therein for 0.5 –60 minutes at a temperature of 50°–120° C. Preferred swelling agents include alcohols of 1 –4 carbon atoms such, for example, as methanol, ethanol and propanol, the ketones such as acetone and methyl ethyl ketone, and dioxane, dimethylformamide, dimethylacetamide, dimethyl sulfoxide, and the other polar solvents. For adjusting the degree of swelling so that it does not become too great, water can be added in an amount up to about 40 % by weight.

This swelling treatment is usually carried out by either the batch or continuous method immediately following the curing treatment. Further, when it is intended to make knit or woven fabrics having especially large number of crimps and abounding in elasticity by using this fiber, it is also possible to obtain such a fabric by a procedure consisting, say, of first developing in the fiber, after its cure, such number of crimps as will be suitable to permit the smooth operation of the spinning and knitting or weaving steps, and then, after the fibers have been knit or woven into a fabric, again submitting the fibers to a strong swelling treatment thereby obtaining a knit or woven product excelling in elasticity.

The self-crimping phenolic composite fiber of this invention, when treated under suitable tension with either wet or dry heat, can have part of its crimps removed, which crimps are made latent. These crimps which have been made latent can again be made manifest by submission to a suitable heat treatment under relaxed conditions.

The invention composite fiber, as a yarn spun from its staple form or as a continuous filament yarn, can be processed into heat resistant and flameproof textile products having the form of an elastic knit or woven product or a nonwoven fabric.

The following examples are given for more specifically illustrating the present invention. The parts and percentages in the examples are on a weight basis.

EXAMPLE 1

1410 parts of phenol, 1180 parts of formalin (37 % aqueous solution), 20 parts of oxalic acid and 200 parts of methanol were reacted for 3 hours by heating at 100° C. with stirring, after which the reaction was terminated by the addition of a large quantity of cold water. The resulting phenolic resin was dissolved in methanol, and the unreacted phenol, formaldehyde and methanol and some water were distilled off by heating under reduced pressure to obtain a heat-meltable novolak resin of a number average molecular weight of 820. 950 parts of the so obtained novolak resin and 50 parts of nylon 12 (relative viscosity as measured in 0.5 % metacresol = 1.80) were mixed with stirring under a stream of nitrogen in an agitator-equipped autoclave for 3 hours at 210° C. under molten conditions. Then after debubbling the mixture under reduced pressure, the mixture was withdrawn from the bottom of the autoclave, and chips 0.25 mm in diameter and 0.3 mm long were prepared by the hot cut procedure. This is designated modified phenolic resin component A.

On the other hand, chips 0.25 mm in diameter and 0.3 mm long were also prepared by the hot cut procedure from the aforesaid heat-meltable novolak resin. This is designated phenolic resin component B. Next, these two components of chip form were separately melted in screw extruders at 200° C., following which they were compositely spun. The molten polymers were delievered by means of their respective gear pumps at a liquid feed ratio of 1/1 to a conventional composite spinneret and united in a side-by-side form and extruded through orifices 0.25 mm in diameter located at the face of the spinneret at 190° C. to form composite filaments, which were cooled in air and wound up at a spinning speed of 1000 meters per minute. The spinning was carried out satisfactorily with no breakage of yarn. By way of comparison, when the foregoing components, A and B were spun alone by feeding them separately to extruding spinning machines held at 200° C., it was possible to spin the component A satisfactorily, but in the case of component B, yarn breakage occurred every few minutes.

Next, these several heat-meltable fibers were immersed in a combined aqueous solution bath of 18 % hydrochloric acid and 15 % formaldehyde at a bath ratio (fiber weight : bath liquid weight) of 1 : 100, after which the bath temperature was raised up to 95° C. during a period of 2 hours. At this time, helical crimps were only developed in the composite fiber. The reaction was continued for a further 6 hours at 95° C. to further the cure as well as to stabilize the crimps.

The several fibers were then withdrawn from the bath and repeatedly washed in cold water. This was followed by treating the fibers by immersion for 30 minutes at 60° C. in an 8 : 2 (volume) aqueous solution of methanol. After withdrawing the several fibers and washing them in water, they were dried at 80° C. under reduced pressure. The degree of crosslinking of the composite fiber was 32 mol %, and it had 8 crimps per inch.

Tests were continued for measuring the yarn quality and nonflammability of the several fibers. 0.1 gram of each of the fibers was taken and, after the filaments were laid together into a length of 19 centimeters, they were twisted 20 times and then folded in two at the middle. These samples were hung perpendicularly and exposed to a flame of an alcohol lamp by insertion of the sample one centimeter into the flame from the tip thereof. Twenty seconds later, the flame was removed, and the distance of carbonization was measured. Separately, 0.05 gram of each of the fibers was taken, and the filaments were likewise laid together into a length of 19 centimeters, twisted 20 times, and folded in two at the middle. The samples were exposed to the flame of an alcohol lamp for 5 seconds, then the flame was removed, and the fire continuance time of the fibers was determined. The results obtained are shown in Table 1.

Table 1

| | | | | Nonflammability | | Yarn quality | |
|---|---|---|---|---|---|---|---|
| | Fiber | Spinnability | Crimp | Carbonization distance (cm) | Fire continuance time (sec) | Tenacity (g/d) | Elongation (%) |
| Invention product | Composite fiber | good | Yes | 1.5 | 1.5 | 1.4 | 45 |
| Control product (B) | Single fiber | poor | no | 1.5 | 1.0 | 1.3 | 32 |
| Control product (A) | Single fiber | good | no | 2.5 | 4.5 | 1.3 | 41 |

It can be seen that the invention product is superior to the single fiber (B) in its spinnability and, on the other hand, excels in its nonflammability as compared with the single fiber (A).

EXAMPLE 2

The heat-meltable composite fiber prepared in Example 1 was immersed at room temperature in a combined aqueous solution of 18 % hydrochloric acid and 2 % formaldehyde at a bath ratio of 1 : 100, after which the bath temperature was gradually raised up to 65° C. during a period of 5 hours, at which temperature the fiber was treated for a further 3 hours. Next, after withdrawing the fiber from the bath and washing it in water, it was dried under reduced pressure for 3 hours at 70° C. This fiber was then immersed at room temperature in a combined solution consisting of 1300 parts of hydrochloric acid (35.5 % concentrated hydrochloric acid), 1400 parts of formaldehyde (37 % aqueous solution), 240 parts of urea and 2840 parts of methanol at a bath ratio of 1 : 80, following which the bath temperature was raised up to 50° C. during a period of 2 hours, at which temperature the fiber was treated for a further 10 hours to prepare a composite fiber containing the urea bond and having a degree of crosslinking of 21 mol %. The tenacity of this fiber was 1.7 g/d and its elongation was 58 %. Further, it possessed gently sloping crimps at the rate of 21 crimps per inch. When this fiber was cut into 4-inch lengths and spun in customary manner, the spinnability was extremely satisfactory. Further, the so obtained spun yarn had an elongation of 8 –12 %. Again, this fiber excelled in its heat resistance, since its heat evolution starting point as determined by differential thermal analysis was 330° C., a high value. Thus, there is an improvement of about 110° C. as compared with a fiber not containing the urea bonds.

EXAMPLE 3

Chips of the heat-meltable novolak resin obtained in Example 1 and designated therein as component A and nylon-66 chips ($[\eta] = 1.02$ as measured in metacresol at 30° C.) in a prescribed ratio to the former were introduced into a rotary dryer and mixed in their chip state to prepare the component C.

Next, a composite fiber was spun from the components C and B by operating as in Example 1. The resulting fiber was then immersed at room temperature in a combined solution of 15 % hydrochloric acid and 16 % formaldehyde, after which the temperature of the bath was raised up to 90° C. during a period of 2 hours, at which temperature the fiber was treated for 5 minutes. After withdrawing the fiber from the bath and water-washing, it was immersed at 40° C. in a combined aqueous solution containing 30 % of formaldehyde and 2.8 % of ammonia, after which the temperature of the bath was raised up to 95° C. during a period of 1 hour, at which temperature the fiber was cured for one hour. The fiber was then withdrawn from the bath, water-washed and dried, after which it was measured for its nonflammability by the same method as described in Example 1. Further, the elongation and recovery of the fiber were determined as follows:

$$\text{Elongation (\%)} = \frac{L_1 - L_0}{L_0} \times 100$$

$$\text{Recovery (\%)} = \frac{L_1 - L_2}{L_1 - L_0} \times 100$$

where $L_0$ = original length (cm), $L_1$ = length one minute after loading with a 0.15 g/d load (cm) and $L_2$ = length one minute after removal of load (cm).

The results obtained are shown in Table 2.

Table 2

| | Content of nylon 66 in component C | Spinnability | Nonflammability: Carbonization distance (cm) | Nonflammability: Fire continuance time (sec) | Elongation and recovery: Elongation (%) | Elongation and recovery: Recovery (%) |
|---|---|---|---|---|---|---|
| Control product | 0.3 | poor | 1.5 | 1.0 | 15 | 49 |
| Invention product | 0.5 | fair | 1.5 | 1.0 | 35 | 77 |
| " | 1 | " | 1.5 | 1.5–2.0 | 55 | 85 |
| " | 2 | good | 1.7 | 1.5–2.0 | 78 | 90 |
| " | 5 | " | 1.7 | 1.5–2.0 | 110 | 95 |
| " | 7 | " | 1.8 | 2.0 | 120 | 96 |
| " | 10 | " | 2.0 | 2.5 | 140 | 96 |
| " | 30 | " | 2.9 | 3.0 | 150 | 96 |
| Control product | 40 | " | 4.2 | 5.5 | 150 | 97 |

It is apparent from Table 2 that at least 0.5 % of nylon-66 is required when considered from the standpoint of the spinnability and the elongation and recovery rates. On the other hand, it is seen that from the standpoint of nonflammability an amount in excess of 30 % was not desirable. Further, it is seen that the amount of nylon-66 was preferably 1 –10 %, and most preferably 2 –7 %.

On the other hand, in the case where 10 % of nylon was added, as indicated above, but the composite fiber obtained was one in which the phenolic resin nylon-66 was used as the core with an eccentrically disposed sheath disposed enveloping the core, which fiber was then cured in exactly the same manner to obtain a phenolic composite fiber, the elongation was 65% and elongation recovery was 92 %. While the crimp properties were thus somewhat inferior to the side-by-side form, good results were obtained with respect to the fiber's nonflammability in that the carbonization distance was 1.5 cm and the fire continuance time was 1.5 –2.0 seconds.

EXAMPLE 4

Coal-tar pitch and the component B prepared in Example 1 were mixed at a ratio of 30/70 (weight %) to obtain a modified novolak (component D). The so obtained component D and the component B itself were then spun into a side-by-side type composite fiber at a ratio of union of D/B = 7/3 by operating as in Example 1 and thereafter cured by operating as in said example to obtain a self-crimping phenolic composite fiber.

The so obtained composite fiber was highly nonflammable as is apparent from the results obtained when it was tested as in Example 2, the carbonization distance being 1.5 cm and the fire continuance time being 0 –0.5 second.

EXAMPLE 5

1410 parts of phenol, 1180 parts of formalin (37 % aqueous solution), 20 parts of oxalic acid and 50 parts of methanol were reacted for 3 hours by heating at 95° C. with stirring, following which the reaction was terminated by the addition of a large quantity of water. The resulting resin was then treated at 150° C. under reduced pressure to distill off the water and unreacted monomers to obtain a heat-meltable novolak resin of a number average molecular weight of 860. When this resin was passed through a stainless steel mesh of 10-micron size under molten conditions, the resin was formed into beadlike particles. This is designated component $B_1$.

Next, 95 parts of this beadlike phenolic resin and 5 parts of chips of nylon 12 (relative viscosity as measured in 0.5 % methanol of 1.65) were mixed thoroughly in a rotary dryer to obtain a mixture (designated component $A_1$), which was fed to a melt-extruding composite spinning machine of 20-mm diameter held at 200° C. where it was spun into a composite fiber. That is, the foregoing mixture (component $A_1$) and the phenolic resin (component $B_1$) were fed to a usual composite spinneret at a liquid feed ratio of 1/1 by means of gear pumps and, after being united into a side-by-side form, were extruded from orifices of 0.5-mm diameter disposed at the 180° C. spinneret face, followed by cooling in air and winding up at a spinning speed of 800 meters per minute. The spinning was carried out satisfactorily with no yarn breakage. By way of comparison, the foregoing components $A_1$ and $B_1$ were separately fed to an extruding spinning machine held at 200° C. and separately spun. While the spinning in the case of the component $A_1$ could be carried out satisfactorily, yarn breakage occurred every few minutes in the case of the component $B_1$.

Next, the heat-meltable composite fiber obtained by compositely spinning the aforesaid components $A_1$ and $B_1$ was separated from the bobbin and immersed at room temperature in a combined aqueous solution consisting of 17 % hydrochloric acid and 12 % formaldehyde at a bath ratio of 1 : 40, following which the temperature of the bath was raised up to 70° C. during a period of 2.5 hours, at which temperature the reaction was continued for a further 30 minutes. The sheath layer of the fiber was cured by this treatment, but there was no manifestation of crimps.

The so obtained partially cured fiber was immersed at 700° C. in a combined aqueous solution consisting of 3 % hydrochloric acid and 35 % formaldehyde, after which the temperature of the bath was raised up to 95° C. during a period of 30 minutes followed by continuing the reaction for a further 2 hours to further the cure of the fiber to the inner layer thereof. The degree of crosslinking was 32 mol %. Further, there was some development of gentle waves in the resulting cured fiber (on the order of about one wave per 4 inches). This cured fiber was then introduced into methanol at a liquid ratio of 1 : 200 and treated for 10 minutes at 60° C., whereupon were developed uniform crimps at the rate of 4.5 crimps per inch.

On the other hand, the heat-meltable phenolic single fiber obtained from the component $B_1$ only, as hereinbefore described, was cured in exactly the same manner to prepare a cured phenolic fiber to be used as a control product.

The several fibers were cut into 9-cm lengths and, after carding, were prepared into spun yarns. The invention product possessed cardability and adequate tenacity, with the consequence that it could be spun with no trouble at all. In contrast, difficulty was experienced in spinning the control product, since it did not have any crimps. Further, as regards the resulting spun yarn, the invention product had a much greater tenacity than that of the control product, and especially in the case of the elongation, that of the invention product was 5.6 %, which was about two or more times that of the control product. Again, as to the amount of fluffs, there was a great amount in the case of the control product, but hardly any fluffs could be noted in the case of the invention product.

EXAMPLE 6

To the beadlike product consisting of a novolak resin prepared in Example 5 were admixed as in Example 5 in varying ratios nylon-6 chips ($[\eta] = 1.10$, as measured in metacresol at 30° C.) followed by preparing composite fibers as described therein. The resulting fibers were then immersed at room temperature in a combined aqueous solution consisting of 16 % hydrochloric acid and 13 % formaldehyde at a liquid ratio of 1 : 30, after which the temperature of the bath was raised up to 80° C. during a period of 90 minutes, at which temperature the curing treatment was carried out for 40 minutes. Next, after withdrawing the fibers from the foregoing bath, they were immersed at a liquid ratio of 1 : 30 in a combined aqueous solution consisting of 2 % ammonia and 28% formaldehyde, whose temperature was adjusted at 70° C., after which the temperature of the bath was raised up to 90° C. during a period of 20 minutes, at which temperature the reaction was carried out for a further 2.5 hours. After withdrawing the fibers from the bath and thoroughly washing with water, they were immersed in an acetone solution containing 30 % of water at a liquid ratio of 1 : 100 and treated therein for 30 minutes at 65° C. thereby causing the development of uniform crimps. The nonflammability and the elongation and recovery of the several fibers were determined as in Example 1. The results obtained are shown in Table 3.

Table 3

| | Amount added of nylon 6 (%) | Spinability | Nonflammability: Carbonization distance (cm) | Nonflammability: Fire continuance time (sec) | Elongation and recovery: Elongation (%) | Elongation and recovery: Recovery (%) |
|---|---|---|---|---|---|---|
| Control product | 0.3 | poor | 1.5 | 1.0 | 18 | 52 |
| Invention product | 0.5 | fair | 1.5 | 1.0 | 42 | 79 |
| " | 1 | " | 1.6 | 1.5 | 61 | 88 |
| " | 2 | " | 1.8 | 2.0 | 79 | 90 |
| " | 5 | good | 2.0 | 2.5 | 120 | 95 |
| " | 7 | " | 2.4 | 2.5 | 140 | 97 |
| " | 10 | " | 2.8 | 3.0 | 170 | 97 |
| " | 30 | " | 3.2 | 4.0 | 190 | 98 |
| Control product | 40 | " | 5.1 | 7.0 | 200 | 98 |

As is apparent from the results given in Table 3, when considered from the standpoint of spinnability and the elongation and recovery rates, it is seen that at least 0.5 % of nylon-6 is necessary. On the other hand, when 30 % was exceeded, it is seen that undesirable results were had in that the nonflammability, and especially the fire continuance time, was prolonged. Thus, it can be seen that the nylon-6 is preferably incorporated in an amount of 1 –10 %, and most preferably 2 –7 %.

We claim:

1. A method of producing a self-crimping phenolic composite fiber having heat-resistant and flameproof properties, said method comprising melt-spinning (A) a modified phenolic resin obtained by melt blending a heat-meltable uncured novolak resin with 0.5 –30 % by weight, based on the total weight of the mixture, of a heat-metable fiber-forming resin selected from polyamide resin, polyester resin, polyurethane resin or polyolefin resin, and (B) a heat-meltable uncured novolak resin, said melt-spinning being carried out such that the components (A) and (B) are united in an eccentric or side-by-side relationship, and thereafter curing the phenolic resin component contained in the resulting heat-meltable composite fiber.

2. A method of producing a self-crimping phenolic composite fiber having heat-resistant flameproof properties, said method comprising melt-spinning (A) a modified phenolic resin obtained by melt blending a heat-meltable uncured novolak resin with 0.5 –30 % by weight, based on the total weight of the mixture, of a heat-meltable fiber-forming resin selected from polyamide resin, polyester resin, polyurethane resin or polyolefin resin, and (B) a heat-meltable uncured novolak resin, said melt-spinning being carried out such that the components (A) and (B) are united in an eccentric or side-by-side relationship, curing the phenolic resin component contained in the resulting heat-meltable composite fiber and thereafter treating said fiber with a swelling agent.

3. The method of claim 2 wherein said heat-meltable fiber-forming resin is contained in said modified phenolic resin (A) in an amount of 1 –10 % by weight.

4. The method of claim 2 wherein said heat-meltable fiber-forming resin is contained in said modified phenolic resin (A) in an amount of 2 –7 % by weight.

5. The method of claim 2 wherein the weight ratio of said modified phenolic resin (A) to said heat-meltable uncured novolak resin (B) ranges between 10:90 and 90:10.

6. The method of claim 2 which comprises carrying out the cure of the phenolic resin component contained in the heat-meltable composite fiber until a degree of crosslinking of 5 –45 mol % is achieved.

7. The method of claim 2 which comprises carrying out the cure of the phenolic resin component contained in the heat-meltable composite fiber until a degree of crosslinking of 10 –35 mol % is achieved.

8. The method of claim 2 wherein said heat-meltable fiber-forming resin is a polyamide.

9. The method of claim 2 wherein said curing treatment is carried out by a two-stage process consisting of a precuring and a curing step.

10. The method of claim 9 which comprises carrying out the curing treatment by a two-stage process consisting of a precuring and a curing step, said precuring step being carried out using a curing bath in which the content of the acidic catalyst is greater than that of the aldehyde, and said curing step being carried out using a curing bath in which the content of the acidic or basic catalyst is less than that of the aldehyde.

11. The method of claim 1 wherein said heat-meltable fiber-forming resin is contained in said modified phenolic resin (A) in an amount of 1 –10 % by weight.

12. The method of claim 1 wherein said heat-meltable fiber-forming resin is contained in said modified phenolic resin (A) in an amount of 2 –7 % by weight.

13. The method of claim 1 wherein the weight ratio of said modified phenolic resin (A) to said heat-meltable uncured novolak resin (B) ranges between 10:90 and 90:10.

14. The method of claim 1 which comprises carrying out the cure of the phenolic resin component contained in the heat-meltable composite fiber until a degree of crosslinking of 5 –45 mol % is achieved.

15. The method of claim 1 which comprises carrying out the cure of the phenolic resin component contained in the heat-meltable composite fiber until a degree of crosslinking of 10 - 35 mol % is achieved.

16. The method of claim 1 wherein said heat-meltable fiber-forming resin is a polyamide.

17. The method of claim 1 wherein said curing treatment is carried out by a two-stage process consisting of a precuring and a curing step.

18. The method of claim 17 which comprises carrying out the curing treatment by a two-stage process consisting of a pre-curing and curing step, said precuring step being carried out using a curing bath in which the content of the acidic catalyst is greater than that of the aldehyde, and said curing step being carried out using a curing bath in which the content of the acidic or basic catalyst is less than that of the aldehyde.

* * * * *